US005458617A

United States Patent [19]

Byström

[11] Patent Number: 5,458,617

[45] Date of Patent: Oct. 17, 1995

[54] TRACTION DEVICE

[76] Inventor: Johan A. Byström, Nordanås 1058, S-891 92, Örnsköldsvik, Sweden

[21] Appl. No.: 74,824

[22] PCT Filed: Nov. 28, 1991

[86] PCT No.: PCT/SE91/00808

§ 371 Date: Jul. 30, 1993

§ 102(e) Date: Jul. 30, 1993

[87] PCT Pub. No.: WO92/10242

PCT Pub. Date: Jun. 25, 1992

[30] Foreign Application Priority Data

Dec. 10, 1990 [SE] Sweden ..... 9003932

[51] Int. Cl.[6] ..... A61H 1/02

[52] U.S. Cl. ..... 606/241; 482/105

[58] Field of Search ..... 606/421–425, 606/57; 482/105

[56] References Cited

U.S. PATENT DOCUMENTS

| | | | |
|---|---|---|---|
| 2,241,833 | 5/1941 | Waller | 482/105 |
| 3,278,184 | 10/1966 | Rosenbaum . | |
| 3,751,031 | 8/1973 | Yamauchi | 606/241 X |
| 3,924,851 | 12/1975 | Winston | 482/105 |
| 4,239,211 | 12/1980 | Wilkerson | 482/105 |
| 4,369,967 | 1/1983 | Kimura | 482/105 |
| 4,556,215 | 12/1985 | Tarbox et al. | 482/105 |
| 4,905,991 | 3/1990 | Alston | 482/105 |
| 4,966,365 | 10/1990 | Winston | 482/105 |
| 5,105,804 | 4/1992 | Van Nostrand | 606/241 |
| 5,127,891 | 7/1992 | Winston | 482/105 X |
| 5,162,032 | 11/1952 | Dohner | 482/105 |

FOREIGN PATENT DOCUMENTS

| | | | |
|---|---|---|---|
| 1568081 | 5/1980 | United Kingdom | 482/105 |
| 2137515 | 10/1984 | United Kingdom . | |

*Primary Examiner*—Peter A. Aschenbrenner
*Attorney, Agent, or Firm*—Cushman Darby & Cushman

[57] ABSTRACT

For applying traction to an arm or a leg, an elongated body of elastic fabric is provided, which has a plurality of evenly distributed pockets that are elongated transversally of the body. Thin lead strips fit in the pockets as stiffeners. Complementary hook and loop fasteners secure the device around the girth of the arm or leg, so that all of the limb is surrounded by stiffener strips. The inner face of the elastic fabric is provided with a layer of anti-slip material, such as foam rubber, which extends beyond the elastic fabric, both lengthwise and widthwise, of the device. By preference, the device is arcuate in plan and the pockets and stiffener strips correspondingly trapezoidally shaped, when intended to fit around the tapering part of a limb.

7 Claims, 1 Drawing Sheet

TRACTION DEVICE

BACKGROUND OF THE INVENTION

The present invention relates to a traction device intended to be fastened on an extremity of a person or an animal suffering from joint trouble, in order to eliminate or mitigate the troubles. The device comprises a base material on which a number of pockets are arranged, which pockets are intended to carry a varying number of weights. Further, holding means, necessary for the fastening on to the extremity, are permanently attached to the device.

A weight device is previously known through the U.S. Pat. No. 4,303,239. This device, which includes large and bulky weights, is intended to be fastened on the thigh of a person and to be used for the training of the musculature of the thigh. In order to prevent the device from slipping down on the leg, it is equipped with a waist-belt which is coupled to the weight device. However, the known device cannot possibly bring about any traction in the joint of the extremity of the person in question.

Through the U.S. Pat. No. 2,241,833 is further an exercising device previously known. This device, which also comprises large, bulky weights, is intended to be applied on the forearm or the shank of a person, so that the person in question, through raising and lowering of the extremities, may be able to train the arm and leg musculature. This device is thus only intended to be put on the extremity or extremities of the person in question during training. Accordingly it is not intended or suited for the traction of the joint in an extremity. Moreover, the known device is difficult to put on and take off, inasmuch as it has to be fastened with a lace on two sides. Besides, the base material of the exercising device is not made to extend around the whole of the extremity. This means that the number of pockets must be limited and the weights in the pockets have to be made large and bulky, which in turn results in that the device becomes extraordinarily clumsy.

SUMMARY OF THE INVENTION

In contrast to the known devices, the principal object of the present invention is to provide possibilities for the attainment of a continuous traction in the joint in that extremity of a person onto which the present device has been fastened, for instance in the hip-joint of a person who has hip-joint troubles. Furthermore, the present device is so designed that it in a flexible way and without tendency of slipping down will be able to fit tight around the extremity, whereby the person in question will be able to carry his or her traction device inside the trousers or inside the shirt. This has been made possible through the bringing about of a traction device of the to start with mentioned kind, which is characterized by, that the base material extends around principally the whole of the extremity, that the pockets are placed at regular distance from each other around principally the whole of the device, that the pockets have the shape of an oblong, downwards narrowing parallel-trapezium and have a direction, which is principally perpendicular to the longitudinal direction of the device. One or more thin weights having a shape, which corresponds to the shape of the pockets, are intended to be put into each pocket. In this way, the device will function as a traction device for the extremity, so that a continuous traction arises in the joint of the extremity, Moreover, through its arc-shaped longsides of unequal lengths the device acquires such a shape that it in a flexible way fits tight around the extremity, whereby it does not become space-requiring but can be accomodated inside the shirt, the sweater or the trousers on a person.

BRIEF DESCRIPTION OF THE DRAWING

A preferred embodiment of the invention will be described in detail with reference to the drawing attached, in which.

DETAILED DESCRIPTION

Figure 1:
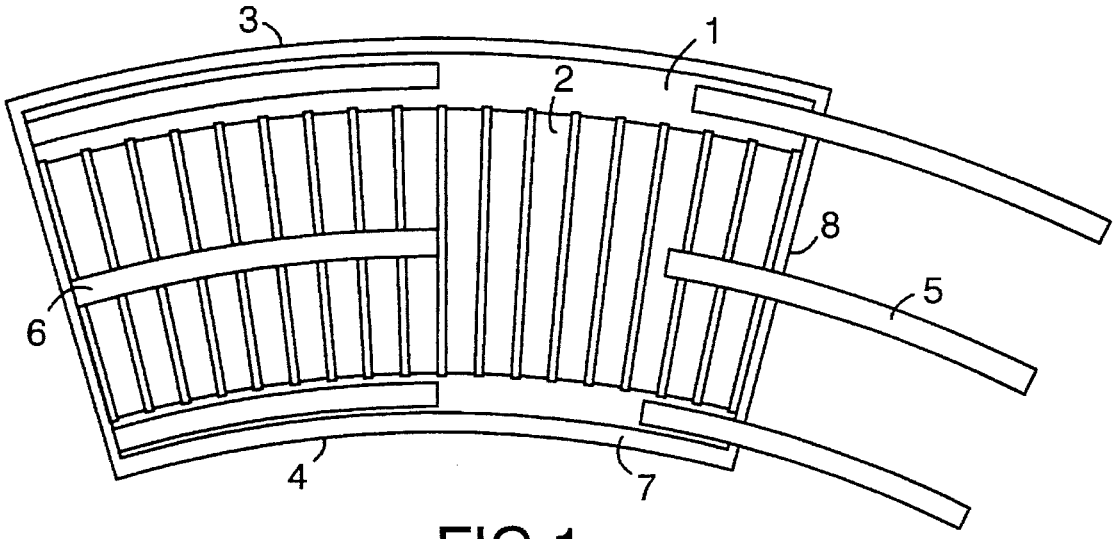
FIG. 1 shows a view of the outside of a traction device in accordance with the invention.

From FIG. 1, which shows a traction device according to the invention, it is evident that the device comprises a base material 1 made from cloth with certain elasticity and with such a length, that the base material can essentially surround, for instance, the thigh or the upper arm of a person, whereby the device can be applied as a cuff around the extremity. On the base material 1 are a great number of pockets 2 are arranged, which, placed at regular distances from each other around essentially the whole of the device, and which have a direction that is principally perpendicular to the longitudinal direction of the device. The pockets 2 have an oblong shape and narrow somewhat towards their bottoms. One or more lead weights are intended to be put into each pocket 2. These lead weights, which each have a weight of about 60 g and is approximately 1 mm thick, have a shape that essentially corresponds to the shape of the pocket. The thickness of the lead weights should be 0.8 to 1.2 mm so that they after a period of use shall be able to mould themselves after the extremity of the bearer. However, the number of pockets 2 shall be so great, and the lead weights so narrow, that one at the applying of the device shall be able to make it fit tight in a flexible way around one's extremity, without having to initially bend the lead weights in their transverse direction. Furthermore, the pockets shall be so arranged, that when the device is applied weights shall appear essentially around the whole of the extremity. In order to avoid blackening when handling the lead weights, these should suitably be covered with a thin coating of plastic lacquer or the like.

The pockets 2 may either be made in the base material itself or be sewn onto it. In the latter case they suitably consist of the base material itself.

The traction device in accordance with FIG. 1 is preferably intended to be applied around the thigh of a person. Thus, in order to give the device a good fit, its upper 3 and lower 4 edges have, in unfolded position, the shape of arcs, at which the lower edge 4 is somewhat shorter than the upper 3. Of course the device may alternatively have such a shape, that the upper and the lower edges are less curved or very nearly straight, for instance for the use on a person, whose upper arm is thin and of uniform thickness.

Further, the traction device comprises means for holding the same around the extremity of a person. These means comprise one or more male means 5 in the form of burdock ribbons, which are intended to co-operate with one or more female means 6 in the form of burdock ribbons (i.e., complementary hook and fleece fasteners). According to the shown embodiment, the male means 5 consist of three separate burdock ribbons, which protrude out from one of the short sides 8 of the device and which are intended to co-operate with female means 6 in the form of three separate burdock ribbons, all of which are permanently applied on the outside of the cloth material 1 and the pockets 2. Of course, one may consider using another type of holding means, but in order to get the device to in a flexible way fit tight around an extremity, it is particularly suitable to utilize burdock ribbons. Burdock ribbons are also suitable to use, in as much as they give good adjustment possibilities for the device, also when the thickness of the extremity onto which it shall be applied varies.

Figure 2:
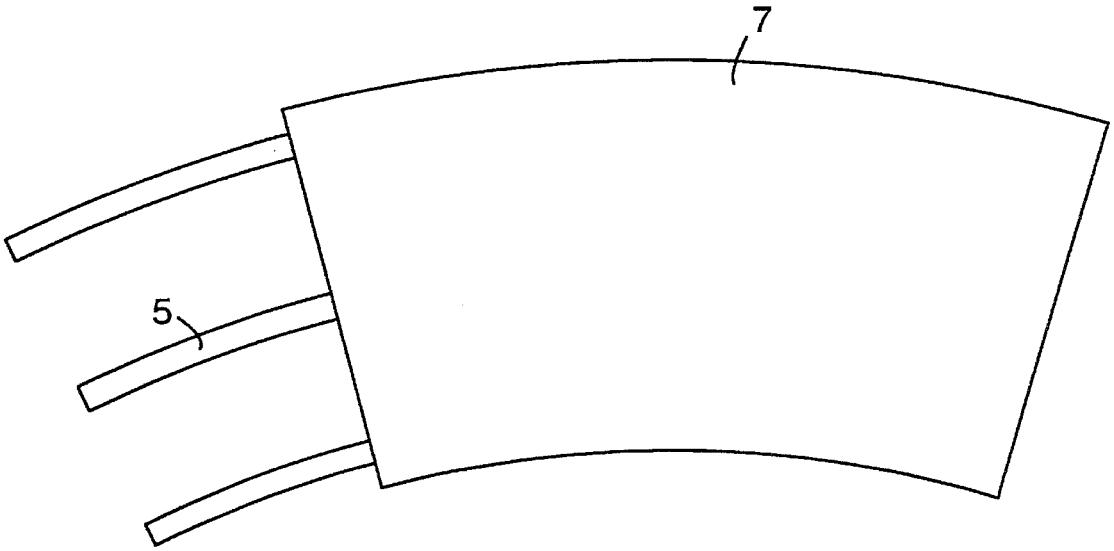
FIG. 2 shows a view of the inside of the device.

In FIG. 2 the inside of the device is shown. As it appears the inside is covered with a material 7, preferably foam rubber, which actively cooperates in keeping the device it its position on an extremity. Thereby, the material has a certain thickness in an embodiment of the device intended for instance to be used on an upper arm, and a greater thickness in an embodiment intended to be used on a thigh of a person.

In order to eliminate the risk of getting pinched when using the device, the foam rubber part 7 preferably extends outside the cloth material 1, viewed in the cross-direction of the device.

In order to completely eliminate the risk of getting pinched when using the invented device, a piece of cloth (not shown in the figure) may be permanently fastened at the short side 8, which piece of cloth at the application of the device is intended to be placed between the skin on the extremity and those at the short side 8 existing burdock ribbons 5. The piece of cloth should suitably extend at least 10 cm out from the short side 8 where it is fastened.

Figure 3:
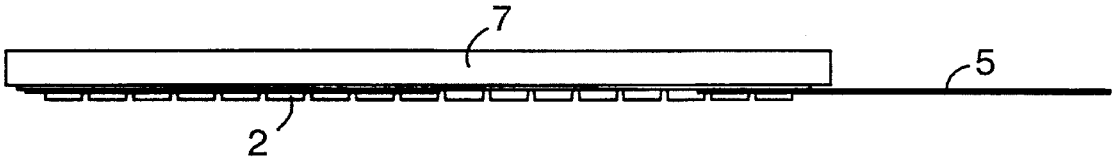
FIG. 3 shows a view of the device standing on its edge.

In FIG. 3, the device in accordance with the invention is shown placed on end. As is plain from this view, the device is very thin, which makes it possible to apply the device on an extremity and have a shirt, sweater or trousers on the outside of it. Furthermore, the device can due to its design be kept in place without tendency of gliding down on the extremity in question. The reason for this is first of all, that the base material is elastic and intended to stretch itself around essentially the whole of the extremity, and that burdock ribbons and foam rubber are used. The holding efficiency of the foam rubber layer can also when needed be strengthened through the placing of shreds of antislip cloth on the surface of the foam rubber layer in the region along the shorter long side 4 of the device.

Particularly suitable has further proven to be to arrange one on the base material 1 on the outside of the device permanently mounted cloth lid (not shown in FIG. 1). This cloth lid should suitably be mounted directly above the openings of the pockets 2, so that one by the folding down of the lid over the openings of the pockets 2 and locking of the same in folded down position can safely retain those into the pockets 2 put weights, also when the device is turned upside down. The locking of the lid is preferably brought about with the help of pieces of male and female burdock ribbons respectively mounted on the inside of the lid and on the outside of the pockets 2.

Another important advantage with the present invention is, that the traction effect on the extremity can be adjusted through putting varying numbers of weights in each pocket depending partly on the extent of joint troubles the person in question has, partly on the muscle capacity of the person. This means, that with light joint troubles, the weight load becomes small, while it becomes high, when the troubles are great.

The present traction device can also very well be used on animals, that suffer from joint trouble. Thus practical tests on horses have given very positive results.

Through practical trials at a handicap institution it has been proven, that the traction device according to the invention with great advantage can be used on the disabled persons at their bath and training in order to give them balance and increased ability to move. Especially when bathing the extremities of the body may be balanced so, that the disabled persons can float in good balance, which makes them feel safe in the water.

The invention is of course not limited to the described embodiment, but may be modified within the scope of the following patent claims.

I claim:

1. A traction device having two opposite long sides and two opposite short sides and arranged to be applied on an extremity having a given girth of a person or an animal, comprising:

a base material having an outside and an inside, said base material being sized to extend around the entire girth of said extremity;

plurality of elongated pockets provided on the outside of the base material, extending perpendicularly to the longitudinal direction of the device and into each of at least some of which at least one thin weight is inserted, said pockets being positioned at a regular distance from each other along the entire length of said base material;

said inside, for facing the extremity, being covered with an anti-slip material arranged for cooperating actively with the extremity in keeping the device in position on the extremity; and retaining means for removably securing said traction device disposed in encircling relation to the extremity.

2. The traction device of claim 1, wherein:

the base material is provided with two parallel, arc-shaped long sides, and that one said long side is longer than the other.

3. The traction device of claim 1, wherein:

the pockets are made in the base material itself; and the number of pockets is so great and the weights therein are so narrow that the traction device can adapt itself in a flexible way and fit tightly around the extremity without the weights having to be bent.

4. The traction device of claim 1, wherein:

the weights are made of lead;

each of the pockets and each of the weights has the form of an oblong, narrowing towards one end, isosceles parallel-trapezium; and weights correspond in size to the respective pockets.

5. The traction device of claim 4, wherein:

the weights each have a thickness of 0.8 to 1.2 mm and, therefore, are easy to bend, whereby they are pliantly adaptable to flexing of the muscles in the extremity onto which the device is applied.

6. The traction device of claim 1, wherein:

the anti-slip material on the inside of the device protrudes longitudinally and transversally beyond the base material.

7. The traction device of claim 1, wherein:

said retaining means are constituted by three complementary sets of burdock ribbons, respectively permanently applied on the outside of the device at one of said short sides and protrude out longitudinally from said one short side, and permanently applied on the outside of the device at the other said short side thereof.

* * * * *